US007946081B1

(12) United States Patent
Frederick

(10) Patent No.: US 7,946,081 B1
(45) Date of Patent: May 24, 2011

(54) EAVES TROUGH AND COVER ASSEMBLIES FOR EAVES TROUGHS

(76) Inventor: Michael J. Frederick, Jackson, MI (US)

( * ) Notice: Subject to any disclaimer, the term of this patent is extended or adjusted under 35 U.S.C. 154(b) by 0 days.

(21) Appl. No.: 12/780,082

(22) Filed: May 14, 2010

Related U.S. Application Data

(63) Continuation-in-part of application No. 12/170,667, filed on Jul. 10, 2008, now Pat. No. 7,743,561.

(51) Int. Cl.
*E04D 13/064* (2006.01)

(52) U.S. Cl. ..... 52/11; 52/12; 52/16; 248/48.1

(58) Field of Classification Search ..... 52/11, 12, 52/16; 248/48.1, 48.2; 210/162
See application file for complete search history.

(56) References Cited

U.S. PATENT DOCUMENTS

| | | | |
|---|---|---|---|
| 406,233 | A | 7/1889 | Phelps |
| 603,611 | A | 5/1898 | Nye |
| 836,012 | A | 11/1906 | Cassen |
| 870,165 | A | 11/1907 | Hagler et al. |
| 891,405 | A | 6/1908 | Cassens |
| 2,537,243 | A | 1/1951 | Swartz |
| 2,569,568 | A | 10/1951 | Lipshaw |
| 2,672,832 | A | 3/1954 | Goetz |
| 2,873,700 | A | 2/1959 | Heier |
| 2,988,226 | A | 6/1961 | Campbell |
| 3,388,555 | A | 6/1968 | Foster |
| 4,404,775 | A | 9/1983 | Demartini |
| 4,435,925 | A | 3/1984 | Jefferys |
| 4,461,128 | A | 7/1984 | Knoebl |
| 4,497,146 | A | 2/1985 | Demartini |
| 4,571,896 | A | 2/1986 | Condie |
| 4,581,857 | A | 4/1986 | Harbom |
| 4,858,396 | A | 8/1989 | Rose et al. |
| 5,444,954 | A | 8/1995 | Anderson |
| 5,519,969 | A | 5/1996 | Golba |
| 5,634,314 | A | 6/1997 | Champagne |
| 5,675,955 | A | 10/1997 | Champagne |
| 5,829,206 | A | 11/1998 | Bachman |
| 5,836,113 | A | 11/1998 | Bachman |
| 6,035,587 | A | 3/2000 | Dressler |
| 6,161,338 | A | 12/2000 | Kuhns |
| 6,205,715 | B1 | 3/2001 | Rex, Jr. |
| 6,272,797 | B1 | 8/2001 | Finger |
| 6,625,941 | B2 | 9/2003 | Shaw |
| 6,688,045 | B1 | 2/2004 | Pilcher |
| 6,883,288 | B1 | 4/2005 | Harbin |
| 6,904,718 | B2 | 6/2005 | Fox |
| 6,988,335 | B2 | 1/2006 | Eyers |
| 7,424,795 | B2 | 9/2008 | Baxter et al. |
| 2003/0037495 | A1 | 2/2003 | Shaw |

FOREIGN PATENT DOCUMENTS

| | | | |
|---|---|---|---|
| JP | 05209450 | A | 8/1993 |

*Primary Examiner* — Brian E Glessner
*Assistant Examiner* — James J Buckle, Jr.

(57) ABSTRACT

A cover assembly for an eaves trough that is connected to a structure for receiving water from the structure includes an elongate body having a plurality of apertures extending therethrough and an upper fastening structure that connects the body to the structure. The elongated body at least partially overlies the structure and the eaves trough to prevent debris from entering an interior of the eaves trough. The apertures overlie the eaves trough such that water travels from the structure onto the body and through the apertures to the interior of the eaves trough. The upper fastening structure has a longitudinally extending first channel member that is connected to the structure, and an upper engaging member disposed on the body near a first longitudinal edge thereof. The upper engaging member is releasably engageable with the first channel member to releasably secure the first longitudinal edge of the body to the structure.

20 Claims, 14 Drawing Sheets

EAVES TROUGH AND COVER ASSEMBLIES FOR EAVES TROUGHS

CROSS-REFERENCE TO RELATED APPLICATIONS

This application is a continuation-in-part of U.S. Pat. No. 7,743,561 issued on Jun. 29, 2010 application Ser. No. 12/170,667, filed on Jul. 10, 2008.

FIELD OF THE INVENTION

The invention relates to the field of eaves troughs, and more particularly, to an eaves trough having a cover portion to prevent debris from entering the eaves trough.

BACKGROUND OF THE INVENTION

It is well known that eaves troughs tend to collect leaves and other debris and thus must be cleaned at regular intervals to prevent clogging. Numerous designs have been previously proposed to prevent debris from entering an eaves trough. Generally, these designs fall into one of two categories. Eaves troughs of the first category of designs include an impervious cap that extends completely over the eaves trough. The caps of such eaves troughs typically include a geometrical feature on the outboard end thereof, such as a semi-circular lip that directs water into the eaves trough but prevents entry of leaves or other debris. The second category of designs regards screens that are attachable to the top surface of the eaves trough or insertable into the eaves trough, wherein the screen allows water to flow therethrough but prevents leaves or debris from entering the eaves trough.

A need remains for an eaves trough cover that is simple to fabricate and install.

SUMMARY OF THE INVENTION

In accordance with one embodiment of the invention, the invention provides a cover assembly for directing water from a structure into an eaves trough, while preventing entry of debris into the eaves trough. The cover assembly includes an elongate body having a plurality of apertures extending therethrough and an upper fastening structure that connects the body to the structure. The elongated body at least partially overlies the structure and the eaves trough to prevent debris from entering an interior of the eaves trough. The apertures overlie the eaves trough such that water travels from the structure onto the body and through the apertures to the interior of the eaves trough. The upper fastening structure has a longitudinally extending first channel member that is connected to the structure, and an upper engaging member disposed on the body near a first longitudinal edge thereof. The upper engaging member is releasably engageable with the first channel member to releasably secure the first longitudinal edge of the body to the structure.

A lower fastening structure may be provided to connect the body to at least one of the structure or the eaves trough adjacent to the second longitudinal edge of the body.

The body may include a longitudinal transition that divides the body longitudinally into an upper portion and a lower portion, wherein the upper portion of the body at least partially overlies the structure and completely overlies the trough, and the lower portion extends downward from the upper portion and inward toward the structure. The lower fastening structure may have a longitudinally extending second channel member that is connected to the structure and a lower engaging member disposed on the lower portion of the body near the second longitudinal edge thereof, the lower engaging member releasably engageable with the second channel member to releasably secure the second longitudinal edge of the body to the structure.

The lower portion of the body may be substantially arcuate and may extend inward from the longitudinal transition toward the structure such that the eaves trough is disposed entirely within a space defined by the body and the structure.

The upper portion of the body may be substantially planar.

The upper portion of the body may extend at an angle of about 90 degrees with respect to the lower portion of the body at the longitudinal transition.

The lower fastening structure may include the second longitudinal edge of the body being configured to be disposed within the interior of the eaves trough such that the body is engageable with the eaves trough to retain the second longitudinal edge of the body within the eaves trough.

The lower fastening structure may include fasteners that connect the body to the eaves trough at or adjacent to the second longitudinal edge of the body.

The lower fastening structure may have a longitudinally-extending second channel member that is connected to the structure, and one or more retainer straps that are connected to the second channel member and the body for securing the second channel member with respect to the body.

A plurality of water guiding members may be disposed on the body, wherein each water guiding member is adjacent to a respective aperture of the plurality of apertures to direct the water into the respective aperture. A water flow path may be defined along at least a portion of the body substantially perpendicular to a longitudinal axis thereof, wherein each aperture is elongated and extends along an axis that forms an acute angle with the water flow path. Each aperture may have an upstream edge and a downstream edge with respect to the water flow path, and a plurality of water guiding members may each extend at least partially upward from the body along the downstream edge of a respective aperture of the plurality of apertures to direct the water into the respective aperture.

The apertures of the plurality of apertures may be aligned in a side-by-side fashion along the longitudinal axis of the body.

BRIEF DESCRIPTION OF THE DRAWINGS

The description herein makes reference to the accompanying drawings wherein like referenced numerals refer to like parts throughout several views and wherein.

DESCRIPTION OF THE PREFERRED EMBODIMENT

Figure 1:
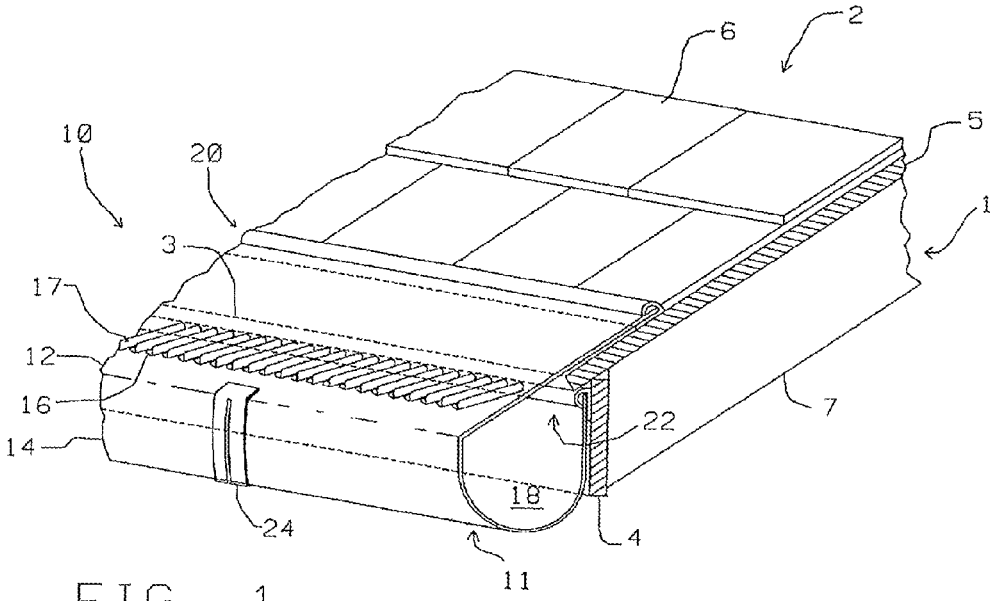
FIG. 1 is a perspective view showing an eaves trough according to the invention connected to a structure.

Referring to the drawings, the present invention will now be described in detail with reference to the disclosed embodiment.

Figure 2:
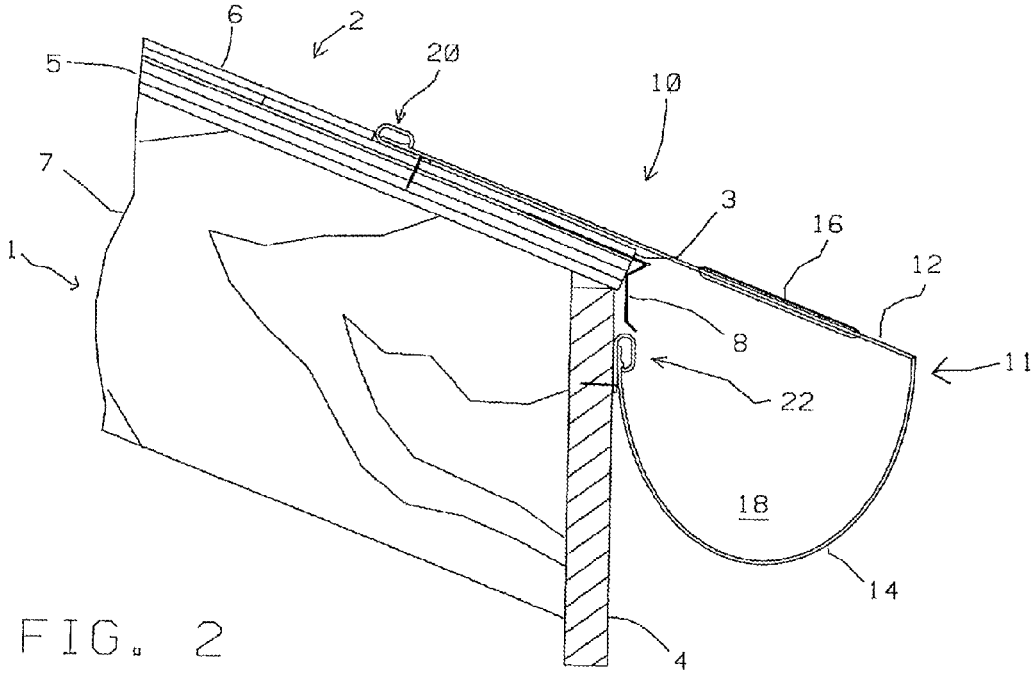
FIG. 2 is a side cross-section view showing the eaves trough connected to a structure.

FIGS. 1-2 show an eaves trough 10 according to the invention for receiving water from a structure 1. The eaves trough 10 is connectable to the structure 1, which may include a downwardly-sloping roof surface 2 having a terminal edge 3 and a fascia 4 that extends generally downward from the roof surface 2 near the terminal edge 3 thereof. The roof surface 2 could be constructed from a decking 5, such as plywood, and a plurality of shingles 6 that are disposed on the decking 5 in a layered fashion. Furthermore, the roof surface 2 may include a drip edge 8 that is typically installed between the decking 5 and the shingles 6 to direct water from the shingles 6 into the eaves trough 10. The roof surface 2 and the fascia 4 may be supported by a plurality of beams or trusses 7. However, it should be understood that the particular details of the structure 1 are included herein for explanatory purposes only and that the eaves trough 10 may be used in conjunction with various structures 1 for receiving water therefrom.

As will be explained in detail herein, the eaves trough 10 includes a body 11, an upper fastening structure 20, and a lower fastening structure 22. The body 11 can be fabricated from an elongate sheet material, such as steel or aluminum or vinyl, and is provided with a cross-sectional shape that defines an upper portion 12 of the body 11 and a lower portion 14 of the body 11 that each extend a long a longitudinal axis of the body 11. A plurality of apertures 16 are formed through the upper portion 12 of the body 11 so that water may flow from the roof surface 2 of the structure 1 onto the upper portion 12 of the body 11 of the eaves trough 10 and through the apertures 16 to a trough 18 that is defined by the lower portion 14 of the body 11 of the eaves trough 10. The upper fastening structure 20 connects the upper portion 12 of the body 11 of the eaves trough 10 to the structure 1, and the lower fastening structure 22 connects the lower portion 14 of the body 11 of the eaves trough 10 to the structure 1. Optionally, hanger assemblies 24 may also be provided to support the eaves trough 10 with respect to the structure 1.

Figure 3:
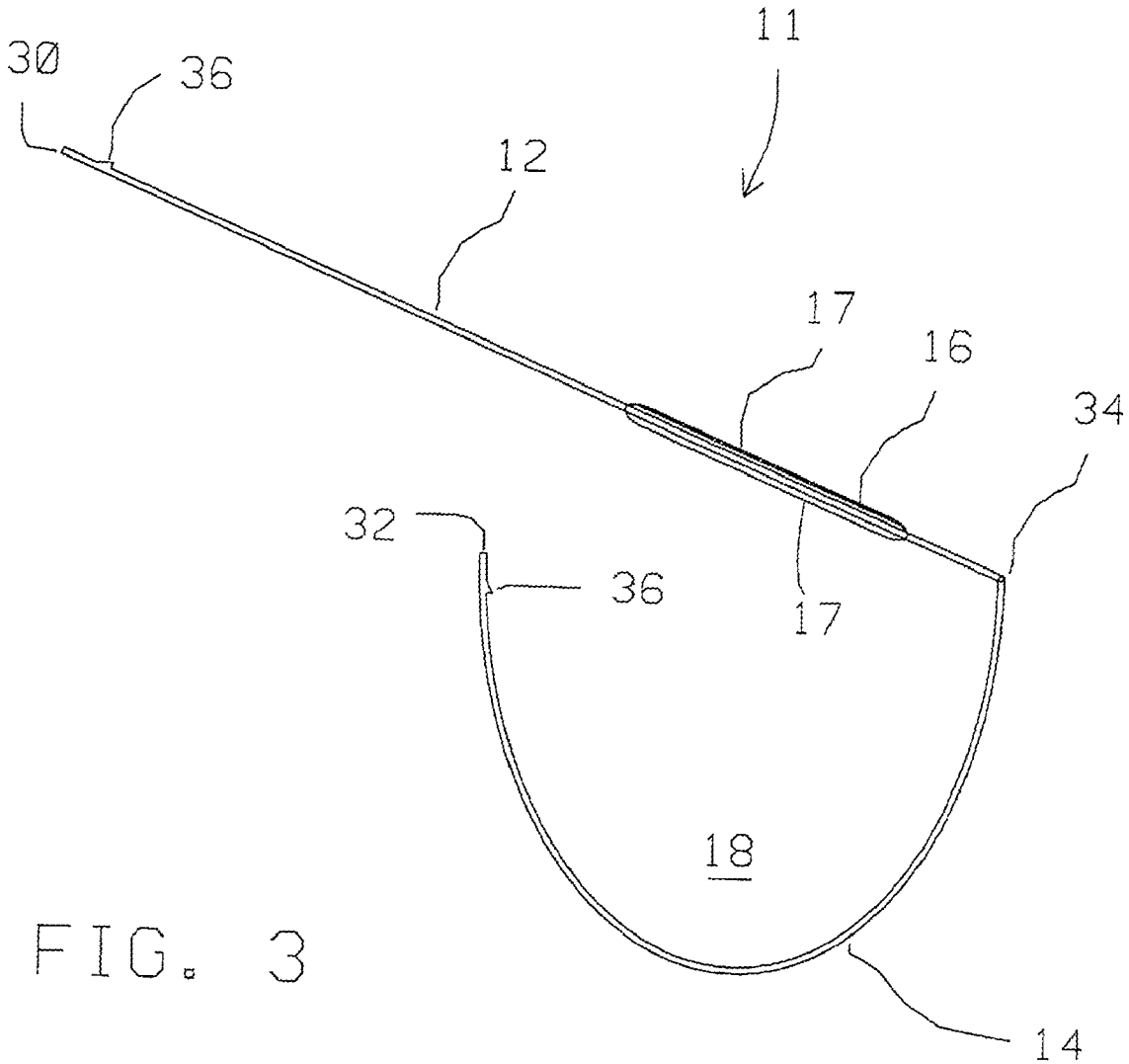
FIG. 3 is a side cross-section view showing a body of the eaves trough.

As best seen in FIG. 3, the body 11 extends integrally from a first longitudinal edge 30 to a second longitudinal edge 32. The upper portion 12 of the body 11 is defined between the first longitudinal edge 30 of the body 11 and a longitudinal transition 34 of the body 11. The lower portion 14 of the body 11 extends from the second longitudinal edge 32 of the body 11 to the longitudinal transition 34 of the body 11. The longitudinal transition 34 is a geometric feature that extends longitudinally along the body 11. For example, the longitudinal transition 34 could be a bend or a curve formed along the body 11 where the upper portion 12 of the body 11 meets the lower portion 14 of the body 11 at an angle, for example, a 90° angle. As another example, with particular regard to a body 11 that is fabricated from vinyl, the longitudinal transition 34 could be a flexible hinge that is formed by reducing the cross-sectional thickness of the body 11 along the longitudinal transition 34.

The upper portion 12 of the body 11 is geometrically configured so that it may receive rainwater from the roof surface 2. Accordingly, the upper portion 12 of the body 11 could be substantially planar. Furthermore, the apertures 16 and their associated water guiding members 17 can be formed on the upper portion 12 of the body 11 such that they substantially overlie the trough 18 that is formed by the lower portion 14 of the body 11.

The lower portion 14 of the body 11 is geometrically configured to form the trough 18 underneath at least a portion of the upper portion 12 of the body 11. In particular, the trough 18 may be directly beneath the apertures 16. The lower portion 14 of the body 11 extends generally downward from the upper portion 12 of the body 11 at the longitudinal transition 34. When the eaves trough 10 is installed with respect to the structure 1, the lower portion 14 of the body 11 can extend generally inward from the longitudinal transition 34 of the body 11 toward the structure 1, such that the second longitudinal edge 32 of the body 11 is adjacent to or in engagement with the fascia 4 or another portion of the structure 1. The lower portion 14 of the body 11 may have a substantially arcuate cross section or a substantially rectangular cross section.

Figure 4:
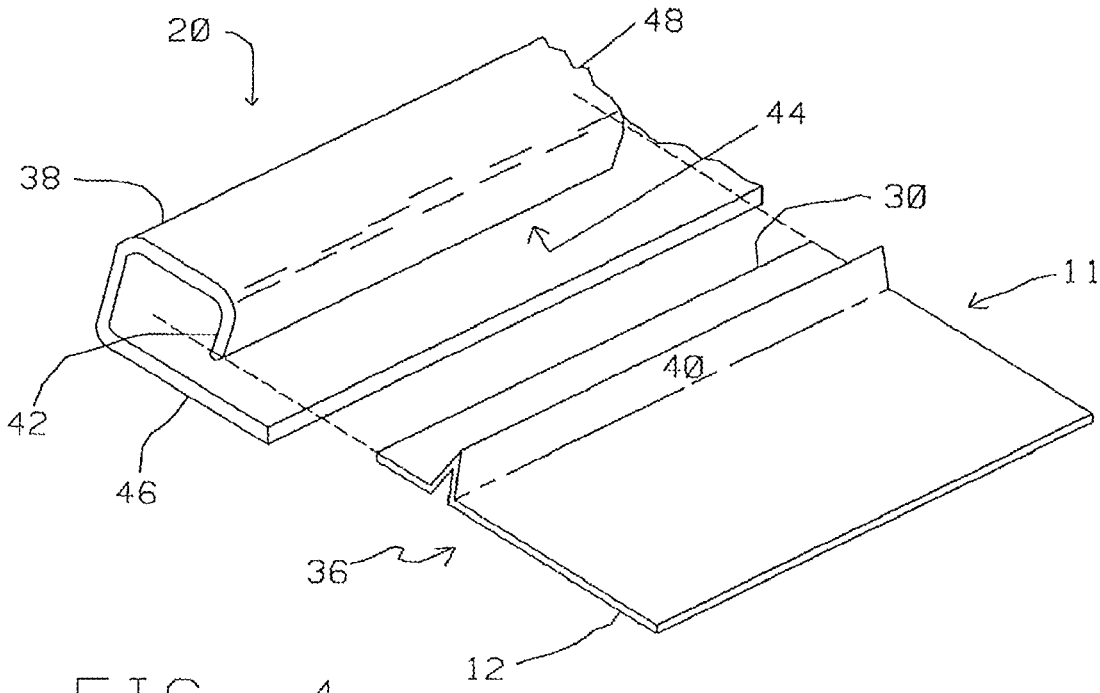
FIG. 4 is a perspective view showing a fastening structure.

The upper fastening structure 20 and the lower fastening structure 22 may each include an engaging member 36 that is formed integrally with the body 11 and a channel member 38, as shown in FIG. 4, wherein the upper fastening structure 20 is shown as representative of both the upper fastening structure 20 and the lower fastening structure 22. The channel member 38 may be any device that is connectable to the structure 1, for example, by fastening with nails, and with which the engaging member 36 can be releasably engaged to connect the body 11 to the structure 1. The engaging member 36 may be fabricated as a fold in the body 11 that creates a longitudinally-extending shoulder 40 that is engageable with a longitudinally-extending interior surface 42 of the channel member 38 that is adjacent to a longitudinal opening 44 of the channel member 38. To define the opening 44, the channel member 38 includes a substantially planar base portion 46 and a C-shaped portion 48 that is resiliently connected to the base portion 46 opposite the opening 44. Thus, the engaging member 36 may be inserted into the channel member 38 by resiliently bending the C-shaped portion 48 of the channel member 38 to widen the opening 44 and then sliding the engaging member 36 through the opening 44. Once the engaging member 36 is disposed within the channel member 38, the shoulder 40 engages the interior surface 42 of the channel to prevent removal of the body 11 from the channel member 38.

Figure 5:
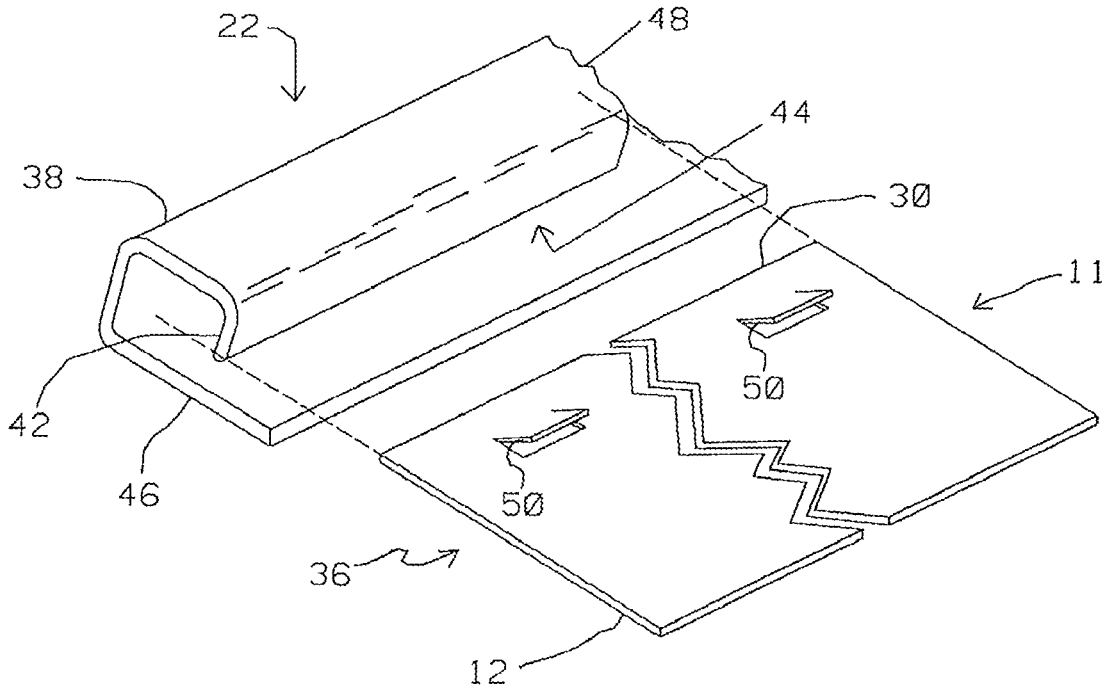
FIG. 5 is a perspective view showing an alternative fastening structure.
Figure 10:
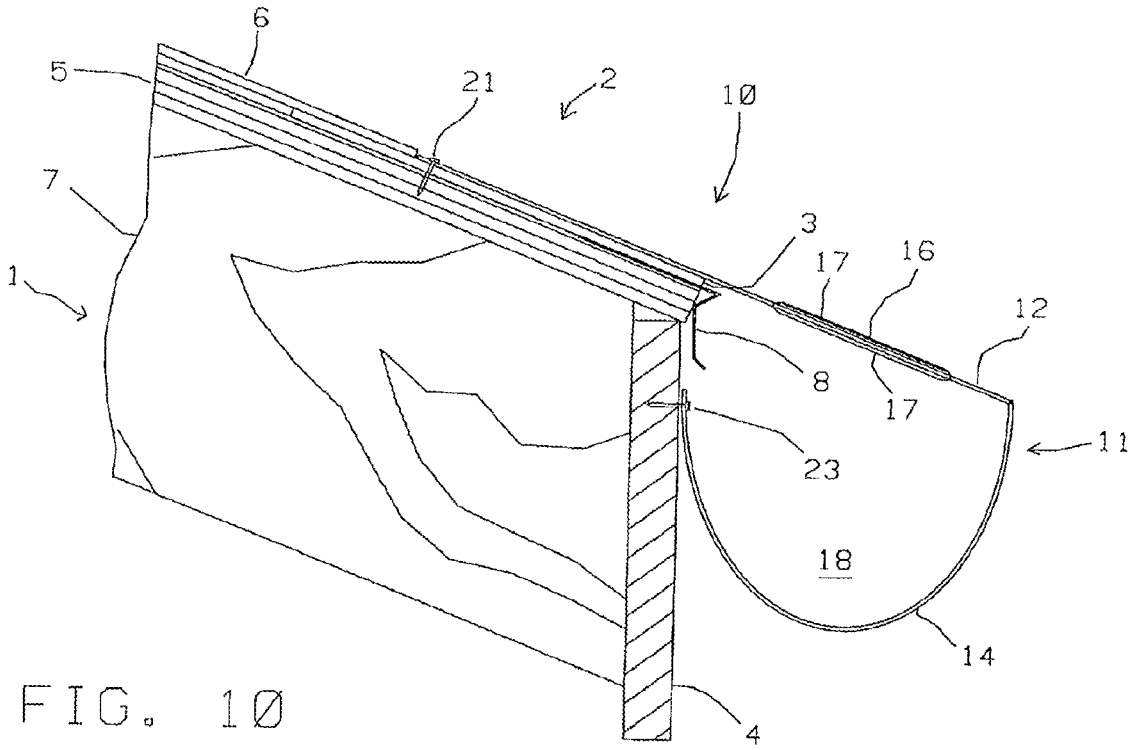
FIG. 10 is a side cross-section view showing the eaves trough connected to a structure using nails.

It should be understood that various structures could be employed as the upper fastening structure 20 and the lower fastening structure 22. For example, the engaging member 36 may include a plurality of generally upstanding tabs 50 that are formed integrally with the body 11, as shown in FIG. 5. The tabs 50 may be fabricated by punching and folding the body 11 or by other suitable methods. As a further alternative, the upper fastening structure 20 and the lower fastening structure 22 could include conventional fasteners, such as nails 21, 23 that connect the body 11 directly to the structure, thereby omitting the channel member 38, as shown in FIG. 10. For example, the first longitudinal edge 30 of the body 11 could be disposed underneath a portion of the shingles 6 of the roof surface 2 and connected to the roof surface 2 by nails 21.

Figure 6:
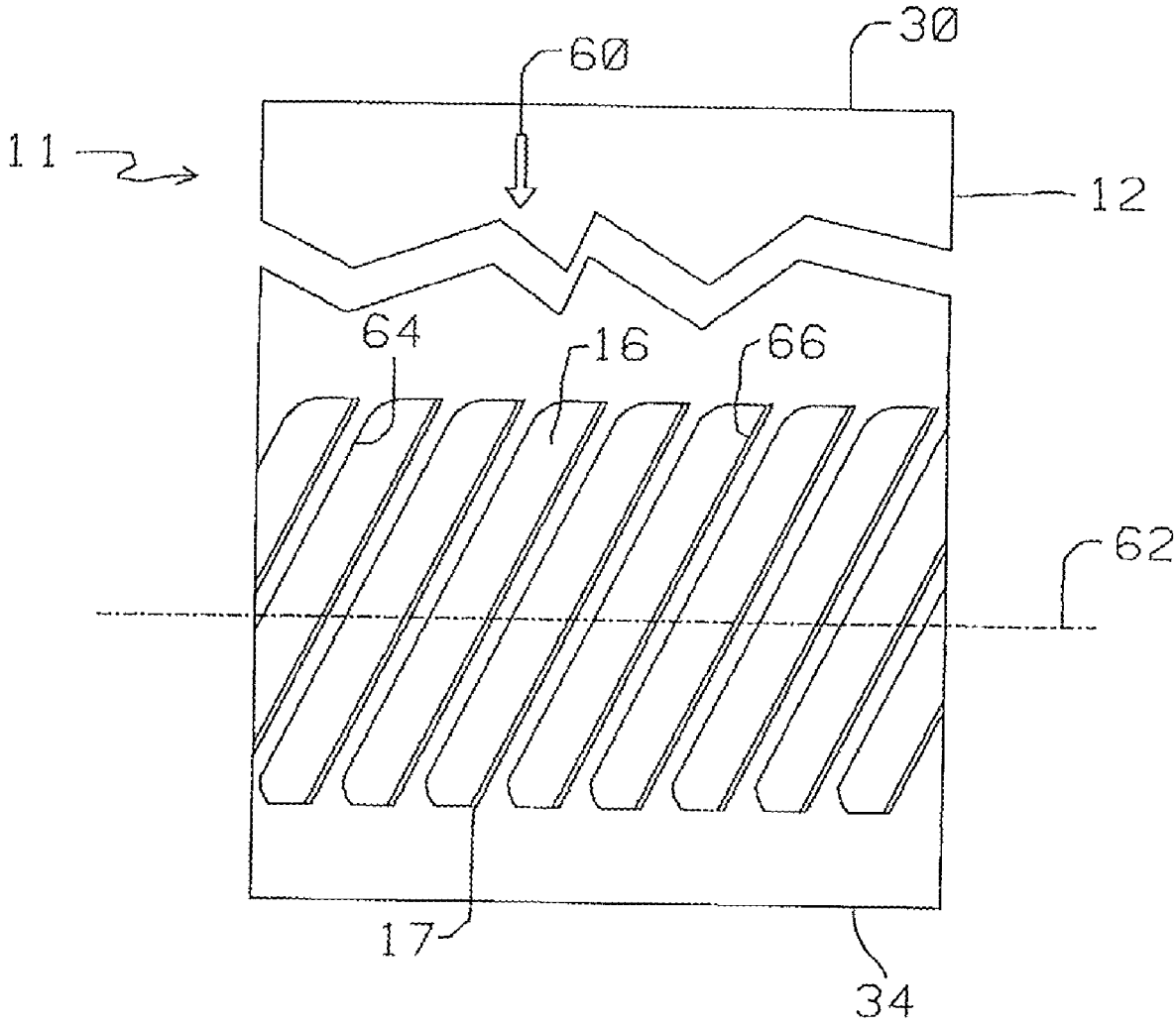
FIG. 6 is a top view showing a plurality of apertures and water-guiding members of the body.

In order to direct rainwater into the trough 18 that is formed by the lower portion 14 of the body 11 of the eaves trough 10, the apertures 16 are provided through the upper portion 12 of the eaves trough 10. As best seen in FIG. 6, a water flow path 60 is defined along the upper portion 12 of the body 11 substantially perpendicular to a longitudinal axis 62 of the body 11. The apertures 16 are elongated and extend at an acute angle with respect to the water flow path 60. For example, the apertures 16 may extend at an angle of between 15° and 75° with respect to the water flow path 60. Furthermore, the apertures may include an elongated upstream edge 64 and an elongated downstream edge 66, wherein the upstream edge 64 is located upstream of the downstream edge 66 with respect to the water flow path 60. Furthermore, the apertures 16 may be aligned in a side-by-side fashion along the longitudinal axis 62 of the body 11, such that the upstream edge 64 of one of the apertures 16 is adjacent to the downstream edge 66 of an adjacent aperture 16.

Figure 7:
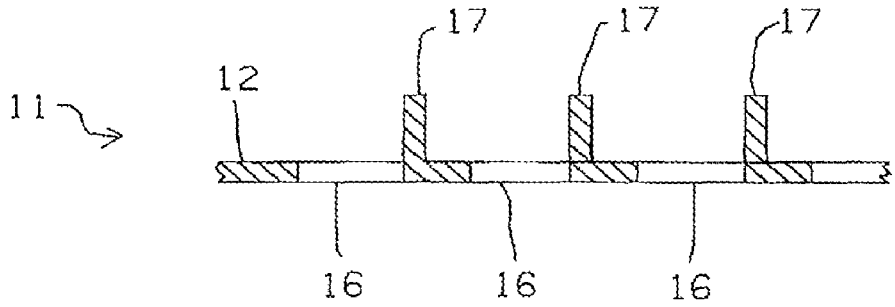
FIG. 7 is a cross-section view of the apertures and water-guiding members shown in FIG. 6.
Figure 8:
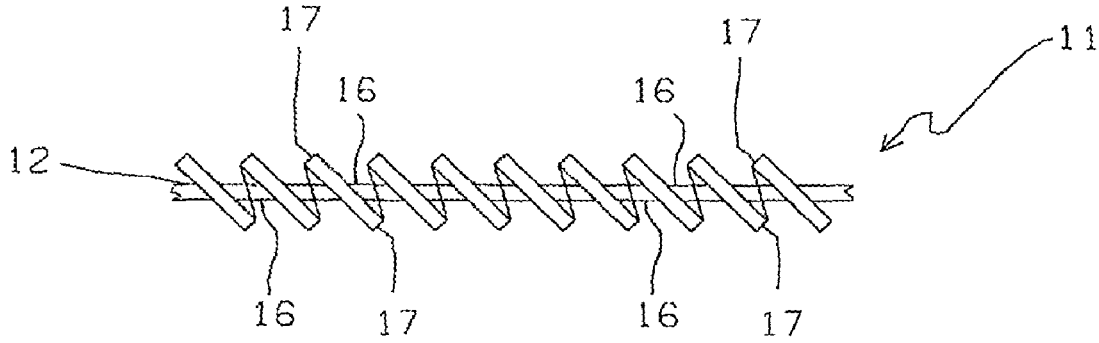
FIG. 8 is a cross-section view showing alternative apertures and water-guiding members.

In order to direct water into the apertures 16, the water-guiding members 17 may be provided adjacent to the apertures 16. As shown in FIG. 7, the water-guiding members 17 may each extend upward from the upper portion 12 of the body 11 along the downstream edge 66 of each aperture 16. The water-guiding members 17 may be formed integrally with the upper portion 12 of the body 11, for example, by fabricating the water-guiding members 17 through a punching and bending operation, wherein a three-sided cut is made into the upper portion 12 of the body 11, and the material bounded by the three-sided cut is folded with respect to the generally planar top surface of the upper portion 12 to provide the water-guiding member 17. Alternatively, as shown in FIG. 8, the water-guiding members 17 may be formed integrally with the upper portion 12 of the body 11 by fabricating the water-guiding member 17 in a louver-like fashion, wherein the water-guiding members 17 extend at least partially upward from the upper portion 12 of the body 11, as well as at least partially downward from the upper portion 12 of the body 11. In particular, the water-guiding member 17 may be fabricated from a punching and folding operation, wherein a series of parallel slits are formed through the upper portion 12 of the body 11 and the intervening material between the slits is twisted with respect to the upper portion 12 of the body 11 to provide the water-guiding members 17.

From the foregoing, it will be understood that the body 11 could be configured such that it may be disconnected from the structure 1, flipped, and reconnected to the structure 1 in an upside-down configuration with respect to the manner in which the body 11 was originally connected to the structure 1. This will cause the directional flow imparted to the water by the water-guiding members 17 to occur in an opposite direction from its previous direction. In particular, by utilizing the tabs 50 of FIG. 5 for the upper fastening structure 20 and the lower fastening structure 22 and also by using the louver-like configuration for the water-guiding member 17, as shown in FIG. 8, connection and use of the body 11 in this upside-down configuration may be accomplished without modifications to the body 11.

Figure 9:
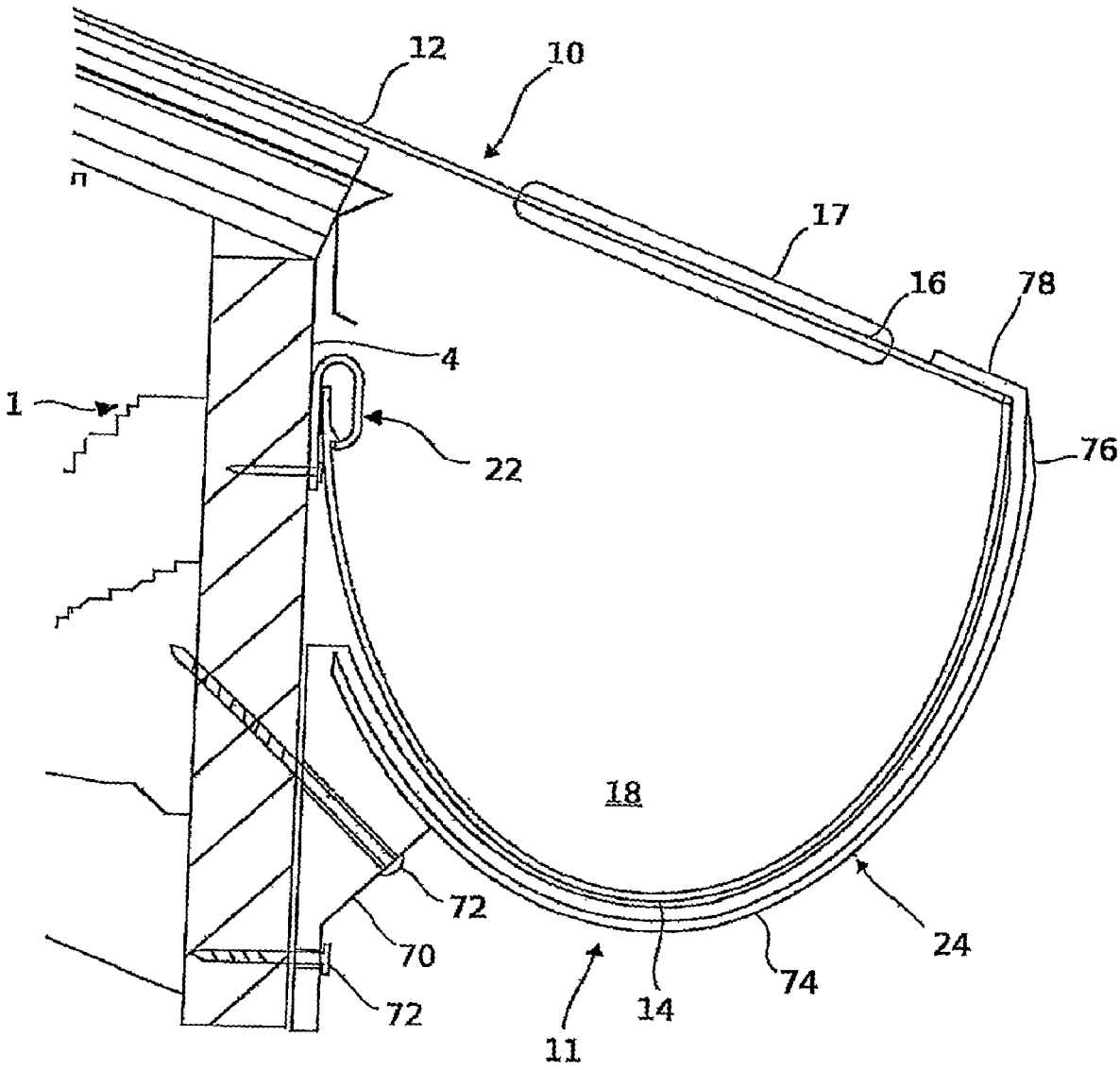
FIG. 9 is a side cross-section view showing the eaves trough connected to a structure, wherein the eaves trough is supported by hanger assemblies.

As shown in FIG. 9, the eaves trough 10 may include the hanger assemblies 24 to provide additional support to the body 11. Each hanger assembly 24 includes a base member 70 that is connected to the structure 1. For example, the base member 70 may be attached to the fascia 4 of the structure 1 by fasteners 72, such as nails or screws. The base member 70 is located below the lower fastening structure 22, and a support arm 74 is connected to the base member 70 is a cantilevered fashion such that the support arm 74 extends generally outward from the structure 1. The support arm 74 is contoured to complementarily engage the lower portion 14 of the body 11, and thus may be substantially arcuate. Furthermore, a retainer 78 may be provided at the outer end 76 of the support arm 74 to engage the upper portion 12 of the body 11, to restrain the body 11 from moving upward with respect to the hanger assembly 24. The retainer 78 may be a flange that is formed integrally with the support arm 74 and that extends generally toward the structure 1 from from the outer end 76 of the support arm 74.

In use, the body 11 of the eaves trough may be fabricated from a stock material, such as steel, aluminum, or vinyl, by bending or folding operations, as well as punching operations. A user installs the eaves trough 10 by connecting the upper fastening structure 20 and the lower fastening structure 22 to the structure 1 and connecting the body 11 to the upper fastening structure 20 and the lower fastening structure 22. The user may optionally install the hanger assemblies 24 to provide additional support for the body 11. Furthermore, the body 11 may be mounted with a slight longitudinal drop toward an outflow pipe (not shown). During a storm, rain water travels from the roof surface 2 of the structure 1 onto the upper portion 12 of the body 11. The rain water is then directed into the apertures 16 by the water guiding members 17 and drops into the trough 18 that is formed by the lower portion 14 of the body 11.

As will be described in detail, the foregoing teachings may be applied not only to eaves troughs, but to cover assemblies for eaves troughs as well.

Figure 11:
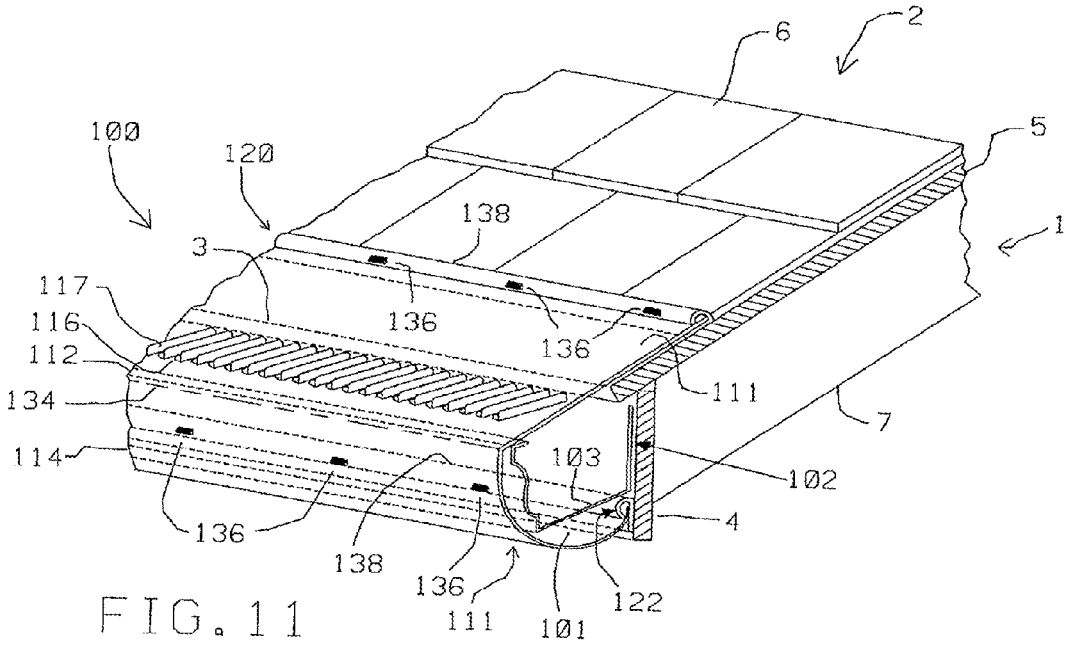
FIG. 11 is a perspective view showing a first embodiment of a cover assembly according to the invention connected to a structure.
Figure 12:
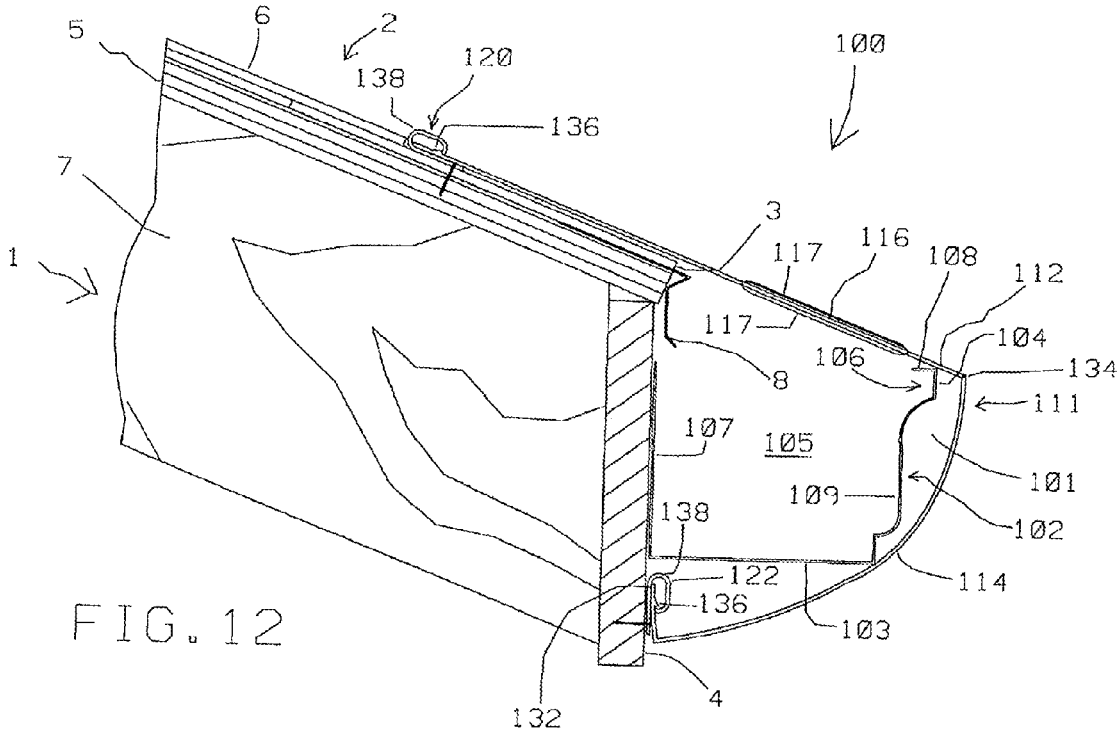
FIG. 12 is a side cross-section view showing the cover assembly of FIG. 11 connected to a structure.

FIGS. 11-12 show a cover assembly 100 according to the invention for directing water from the structure 1 into a conventional eaves trough 102 and for preventing entry of debris into the conventional eaves trough 102. The conventional eaves trough 102 may be any eaves trough now known or later developed. In this embodiment, the cover assembly 100 is connected to the structure 1 both above and below the conventional eaves trough 102, such that it is disposed entirely within a space defined between the cover assembly 100 and the structure 1.

The conventional eaves trough 102 includes a rear wall 107 that is connected to the fascia 4 of the structure 1, a front wall 109 that is opposite the rear wall 107, and a bottom surface 103 that interconnects the rear wall 107 and the front wall 109. All or part of the front wall 109 defines an outermost surface 104 of the conventional eaves trough 102. Adjacent to the outermost surface 104, an inwardly-extending top flange 108 extends inward from the front wall 109 and the outermost surface 104. The foregoing portions of the conventional eaves trough 102 define an interior 105 for the conventional eaves trough 102, in which rainwater may be carried. A portion of the interior 105 of the conventional eaves trough 102 defines an internal notch 106, which is positioned below the inwardly extending top flange 108 and adjacent to the outermost surface 104 of the conventional eaves trough 102. The internal notch 106 may be further defined by the front wall 109 to the extent that it curves or bends inward with respect to the outermost surface 104 that is defined by the front wall 109.

The cover assembly 100 is similar in design and construction to the eaves trough 10. In particular, except as explicitly noted herein, portions of the cover assembly 100 that are analogous to portions of the eaves trough 10 should be considered identical thereto, and those parts will not be described in detail again for the sake of brevity.

Similar to the eaves trough 10, the cover assembly 100 includes a body 111, an upper fastening structure 120, and a lower fastening structure 122. The body 111 defines an upper portion 112 and a lower portion 114. A plurality of apertures 116 and an associated plurality of water-guiding members 117 are provided on the upper portion 112 of the body 111 to direct water into the conventional eaves trough 102. As with the eaves trough 10, a longitudinal transition 134 is defined between the upper portion 112 and the lower portion 114 of the body 111 of the cover assembly 100. The upper fastening structure 120 and the lower fastening structure 122 both include an elongate channel member 138 that is attached to the structure 1 and an engaging member 136 that is adapted to be retained by the channel and may be in the form of the shoulder 40 or the tabs 50 that were described in connection with the eaves trough 10, or may be any other structure suitable to be retained by the channel member 138. In contrast with the eaves trough 10, the lower fastening structure 122 is disposed below the conventional eaves trough 102, such that the conventional eaves trough 102 is located within an enclosed interior 101 that is defined by the cover assembly 100 and the structure 1. As such, the channel member 138 of the lower fastening structure 132 is disposed upon the fascia 4 of the structure and located slightly below the conventional eaves trough 102 such that the channel member 138 of the lower fastening structure 122 extends along the fascia 4 at a substantially uniform distance from the bottom surface 103 of the conventional eaves trough 102.

In use, the conventional eaves trough 102 is first installed with respect to the structure 1. Next, the cover assembly 100 is installed in a manner similar to that described in connection with the eaves trough 10. Thus, the conventional eaves trough 102 is disposed entirely within a space defined between the body 111 and the structure 1. During a storm, rainwater travels from the roof surface 2 of the structure 1 onto the upper portion 112 of the body 111 of the cover assembly 100 and is then directed into the apertures 116 by the water-guiding members 117 and drops into the conventional eaves trough 102.

Figure 13:
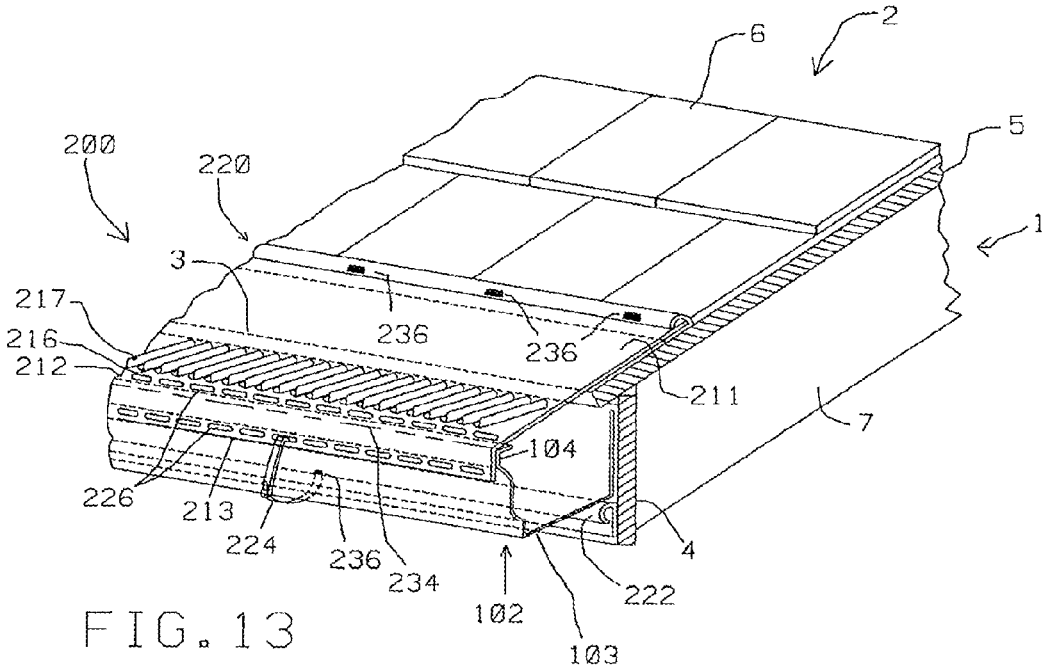
FIG. 13 is a perspective view showing a second embodiment of a cover assembly according to the invention connected to a structure.
Figure 14:
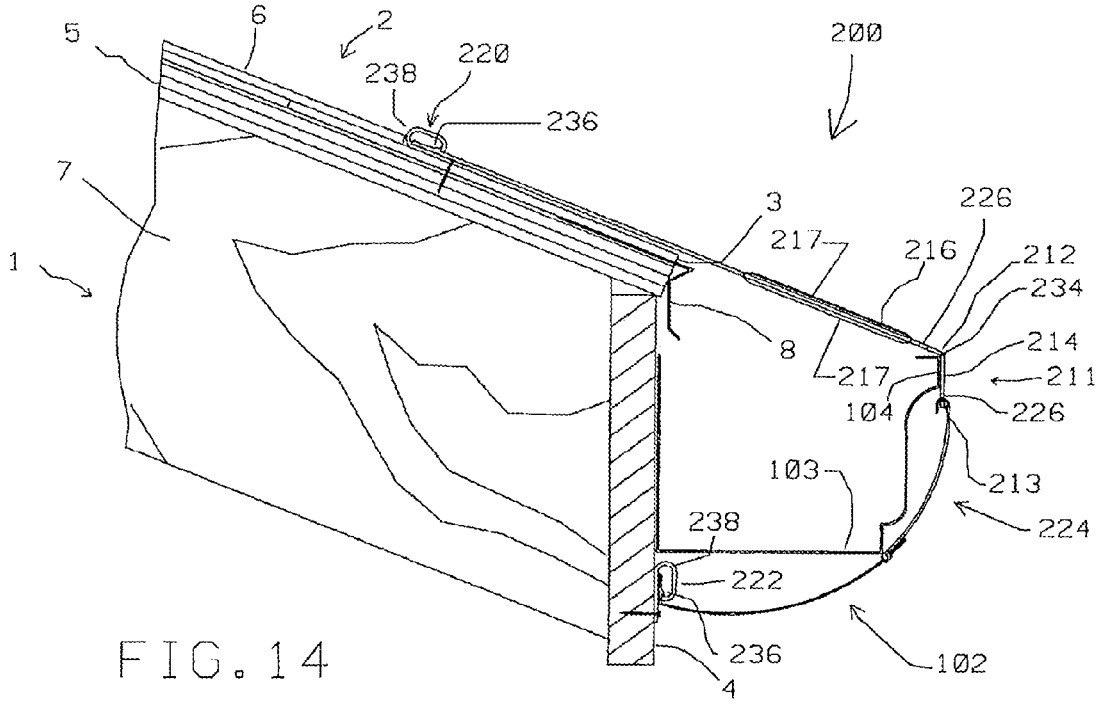
FIG. 14 is a side cross-section view showing the cover assembly of FIG. 13 connected to a structure.
Figure 15:
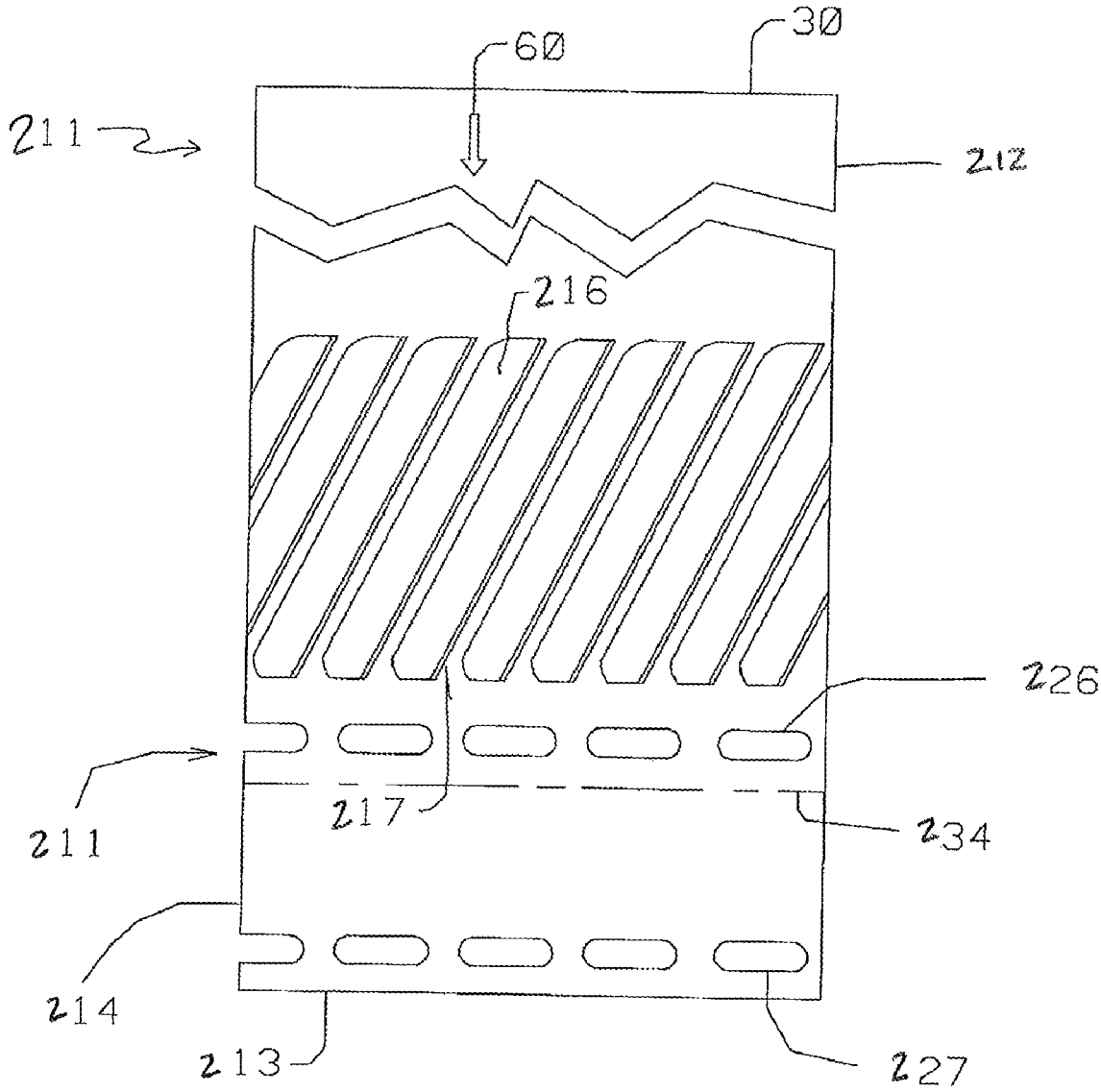
FIG. 15 is a top view showing the cover assembly of FIG. 13.

A second embodiment of a cover assembly 200 is shown in FIGS. 13-15. Again, the various elements of the cover assembly 200 are equivalent to analogous elements of the eaves trough 10 unless explicitly stated otherwise herein.

The cover assembly 200 includes an upper fastening structure 220 and a lower fastening structure 222, both of which include an elongate channel member 238 that is attached to the structure 1 and an engaging member 236 that is adapted to be retained by the channel and may be in the form of the shoulder 40 or the tabs 50 that were described in connection with the eaves trough 10, or may be any other structure suitable to be retained by the channel member 238.

The body 211 of the cover assembly 200 differs from the body 11 of the eaves trough 10 in that it does not extend to the fascia 4. Rather, the body 211 of the cover assembly 200 has an upper portion 212 which extends from the upper fastening structure 220, past the terminal edge 3 of the roof surface 2, and past the outermost surface 104 of the conventional eaves trough 102 before reaching a longitudinal transition 234. A lower portion 214 of the body 211 is defined past the longitudinal transition 234, and an end portion 213 of the body 211 is situated just outward from the outermost surface 104 of the conventional eaves trough 102 and downward from the longitudinal transition 234. Apertures 216 and water guiding members 217 are positioned on the body 211, as described in connection with the respective structures of the eaves trough 10.

In order to secure the body 211 of the cover assembly 200 with respect to the fascia 4 of the structure, a fastener strap 224 is provided at spaced locations along the body 211 of the cover assembly 200. The fastener strap 224 is connected both to the channel member 238 of the lower fastening structure 222 and to one of a plurality of fastening apertures 227 that are formed through the body of the cover assembly 200 adjacent to the end portion thereof. The fastening apertures 227 are positioned along the end portion 213 of the body portion 211 and may be provided in direct correspondence to the locations of the fastening straps 224 or may be provided continuously along the end portion 213 of the body 211 in a side-by-side manner to allow adjustability of the locations of the fastener straps 224. Furthermore, drainage apertures 226 may be provided on the body 211, on the upper portion thereof, and adjacent to the longitudinal transition 234.

Figures 16A, 16B:
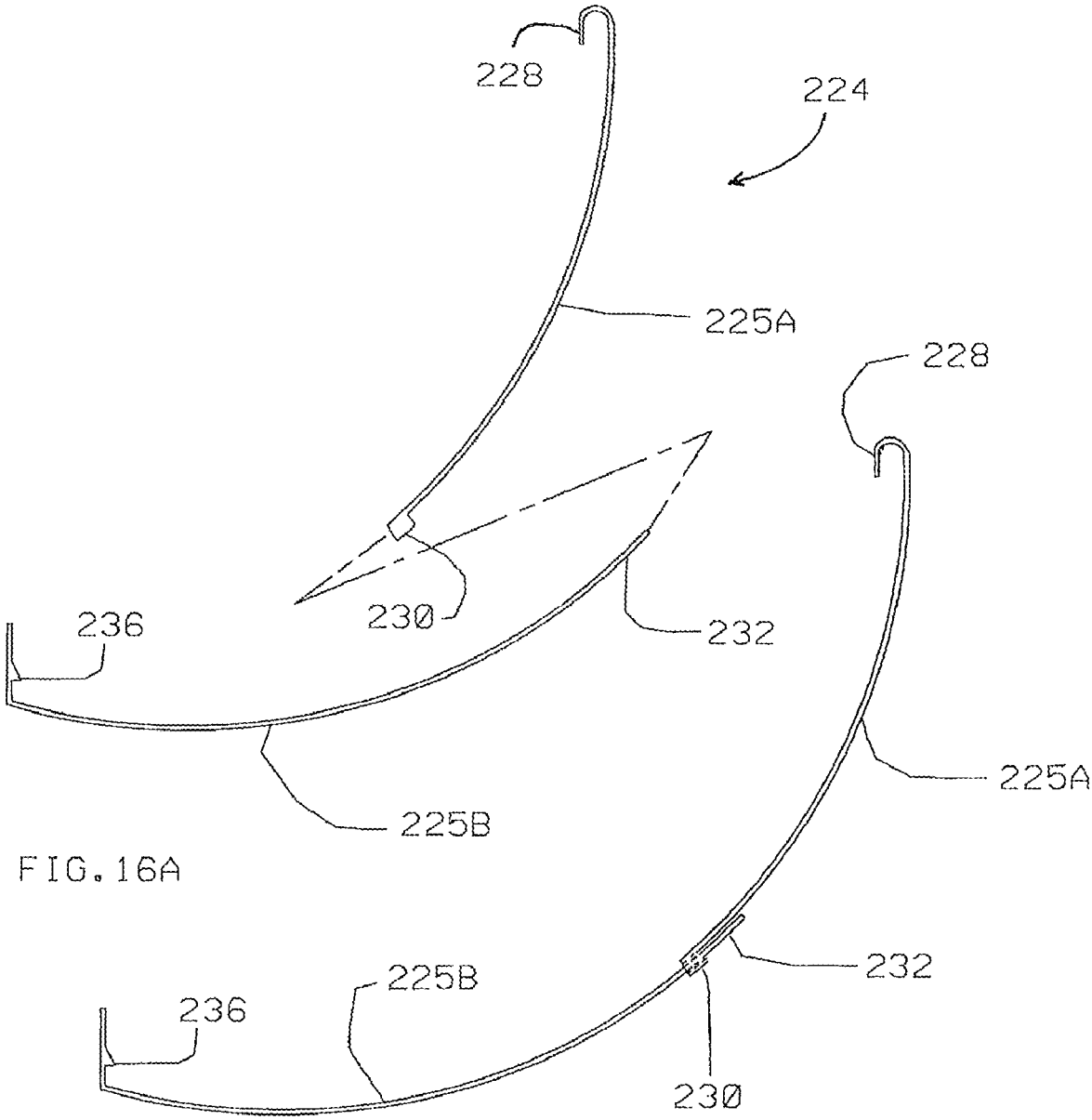
FIG. 16A is a side view showing a fastener strap of the cover assembly of FIG. 13 in a disconnected position.
FIG. 16B is a side view showing the fastener strap of the cover assembly of FIG. 13 in a connected position.

As shown in FIGS. 16A-16B, the fastener strap 224 may be a two-piece structure that includes an upper portion 225*a* and a lower portion 225*b*. A hook 228 or other structure capable of engaging the apertures 226 is provided on the upper portion 225*a* opposite a connecting structure 230 that is engageable with an outer end 232 of the lower portion 225*b* of the fastener strap 224 to allow connection and tensioning of the upper portion 225*a* with respect to the lower portion 225*b* opposite the end 232 of the lower portion 225*b*, and an engaging member 236 is formed on the lower portion 225*b* of the two-part connecting strap for engagement with the channel member 238 of the lower fastening structure 222. Thus, when the upper and lower portions 225*a*, 225*b* of the fastener strap 224 are connected with respect to one another, the body portion 211 of the cover assembly 200 may be secured with respect to the fascia 4 of the structure 1 via the lower fastening structure 222. As shown and described herein, the fastener strap 224 is similar in construction and operation to well-known cable ties; however, it should be understood that other structures could be utilized in place of the fastener strap 224 shown herein, as long as a fastener strap is provided that is operable to engage both the body portion 211 and the channel member 238 of the lower fastening structure 222 in order to supply tension therebetween.

Figure 17:
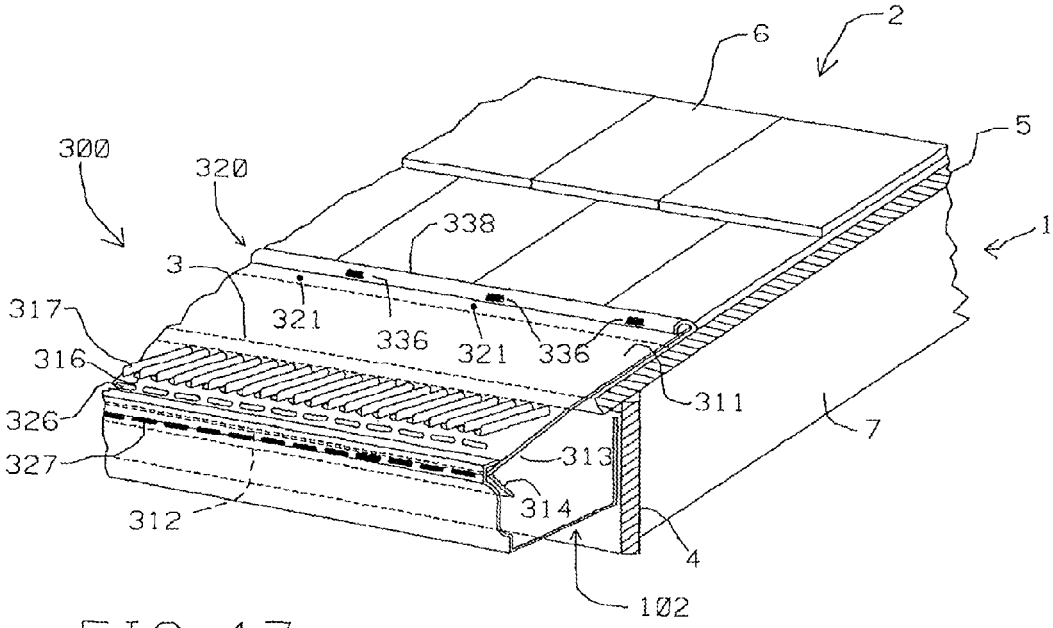
FIG. 17 is a perspective view showing a third embodiment of a cover assembly according to the invention connected to a structure.
Figure 18:
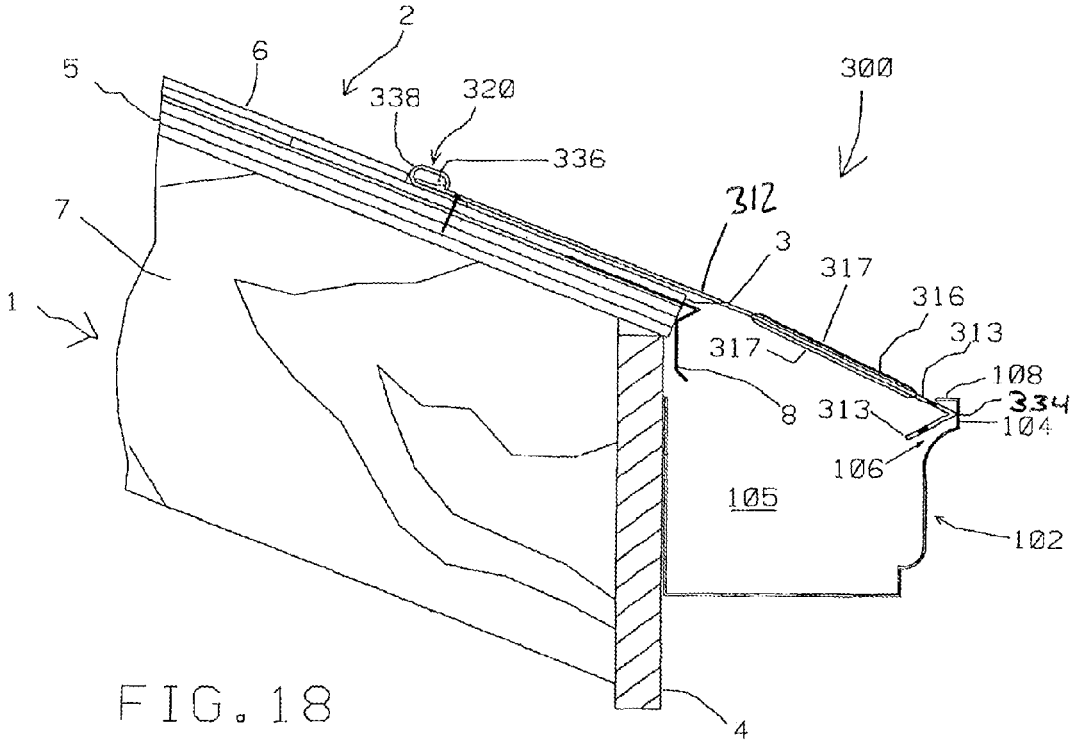
FIG. 18 is a side view of the cover assembly of FIG. 17 connected to a structure.

FIGS. 17-18 show a third embodiment of a cover assembly 300. The cover assembly 300 is similar to the cover assembly 200, but is different therefrom in that the two-part strap 224 may be omitted. Instead, a body 311 of the cover assembly 300 has an end portion 313 that is adapted to be received within the interior 105 of the conventional eaves trough 102. Furthermore, a longitudinal transition 334 between an upper portion 312 and a lower portion 314 of the body 311 may be disposed within the internal notch 106 of the conventional eaves trough 102. The internal notch 106 is defined by the outermost surface 104 of the conventional eaves trough 102 in cooperation with the inwardly-extending top flange 108 that is disposed at an upper end of the outermost surface 104 and extends substantially perpendicular with respect thereto and toward the structure 1. Thus, when the end portion of the body 311 is disposed within the internal notch 106, it is retained therein by engagement with the interiors of the outermost surface 104 and the inwardly-extending flange 108 of the conventional eaves trough 102, thereby securing the cover assembly 300 with respect to the conventional eaves trough 102. A similar result may be obtained by omitting the lower portion 314 and disposing the resulting end portion within the internal notch 106.

The cover assembly 300 includes other structures that are similar to those previously discussed, including an upper fastening structure 320 that has a channel member 338 and a plurality of engaging structures 336 that are formed on the body portion 311, a plurality of apertures 316, a plurality of water-directing members 317, and apertures 326, 327 to allow drainages.

Figure 19:
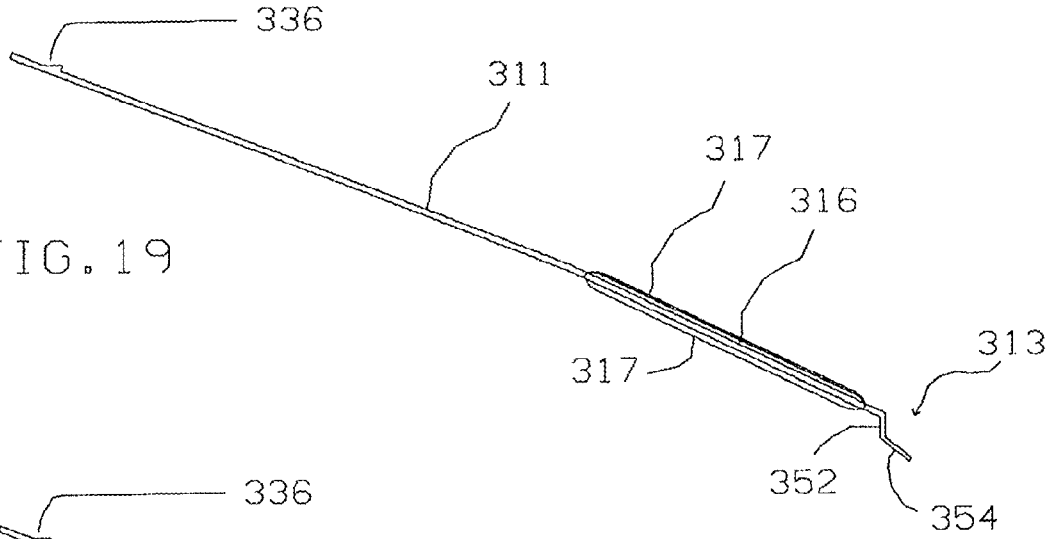
FIG. 19 is a side view showing a first alternative end portion for the body of the cover assembly of FIG. 17.

It should be understood that other geometric configurations could be provided at the end portion 313 of the body 311 as alternatives to the structure shown in FIGS. 17-18. For example, the lower portion 314 may be omitted, and the end portion 313 of the body 311 may include a downwardly extending leg 352 and an outwardly extending leg 354, as shown in FIG. 19. The downwardly extending leg 352 is positioned outward from the apertures 316 of the body 311 and extends at an obtuse angle with respect thereto and may be formed such that the downwardly extending leg 352 is substantially vertical when the body 311 is installed with respect to the conventional eaves trough 102. Also, the downwardly extending leg 352 may be directly adjacent to and inward from the inwardly extending flange 108 of the conventional eaves trough 102 when installed. The outwardly extending leg 354 extends outward and downward from the downwardly extending leg 352 and, when installed, is disposed within the internal notch 106 of the conventional eaves trough 102.

Figure 20:
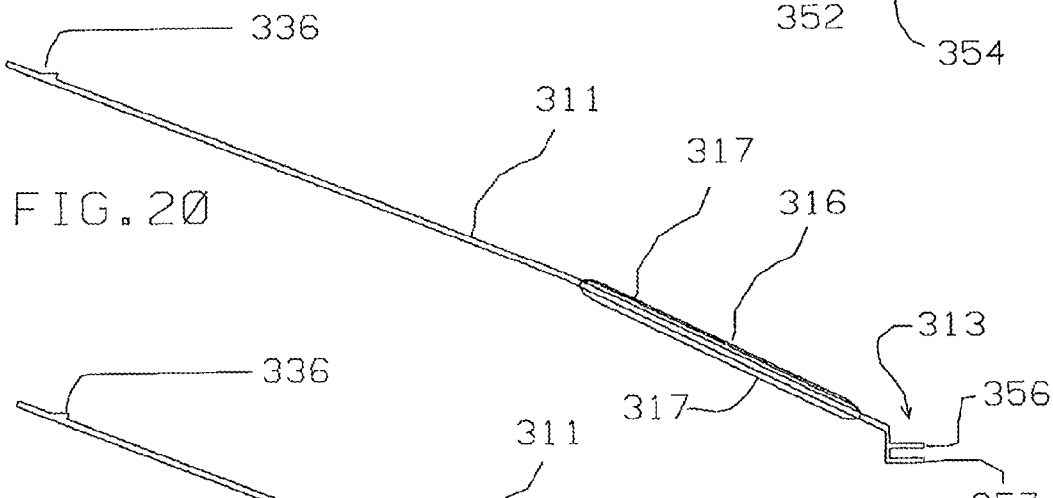
FIG. 20 is a side view showing a second alternative end portion for the body of the cover assembly of FIG. 17.

As another example, the end portion 313 of the body 311 may include a forked structure having an upper flange 356 and a lower flange 357 that extend outward from the body 311 and substantially coplanar with respect to one another such that the inwardly extending flange 108 of the conventional eaves trough 102 is receivable between the upper and lower flanges 356, 357, as shown in FIG. 20. In the example shown in FIG. 20, the flanges 356, 357 extend substantially continuously and are positioned one above the other to define a friction fit. However, this need not be the case.

Figure 21:
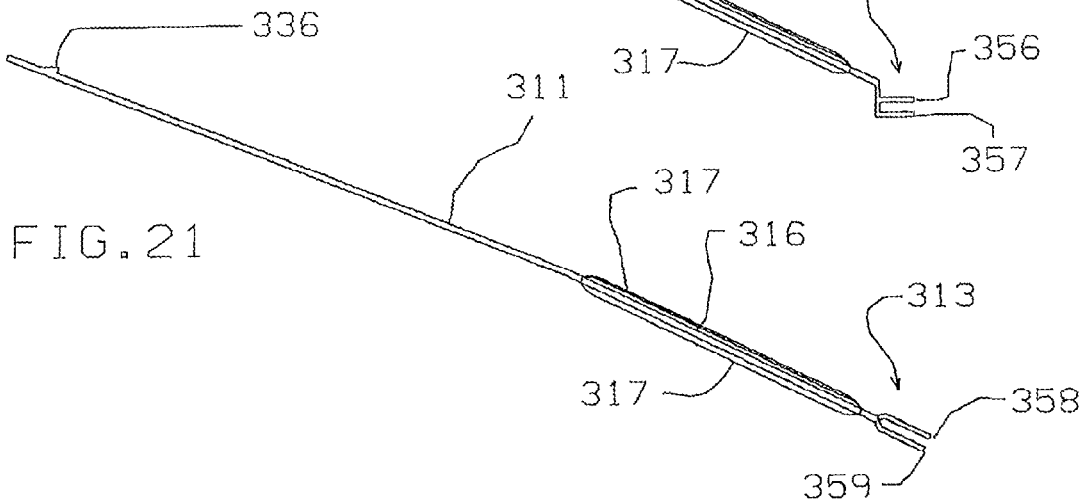
FIG. 21 is a side view showing a third alternative end portion for the body of the cover assembly of FIG. 17.

As another example, as shown in FIG. 21, the end portion 313 of the body 311 may include a forked structure having an upper flange 358 and a lower flange 359 that do not extend continuously along the body 311 but rather alternate laterally along the body 311 with respect to one another such that the inwardly extending top flange 108 of the conventional eaves trough 102 is received between the upper flange 358 and the lower flange 359 in an interleaved manner.

Figure 22:
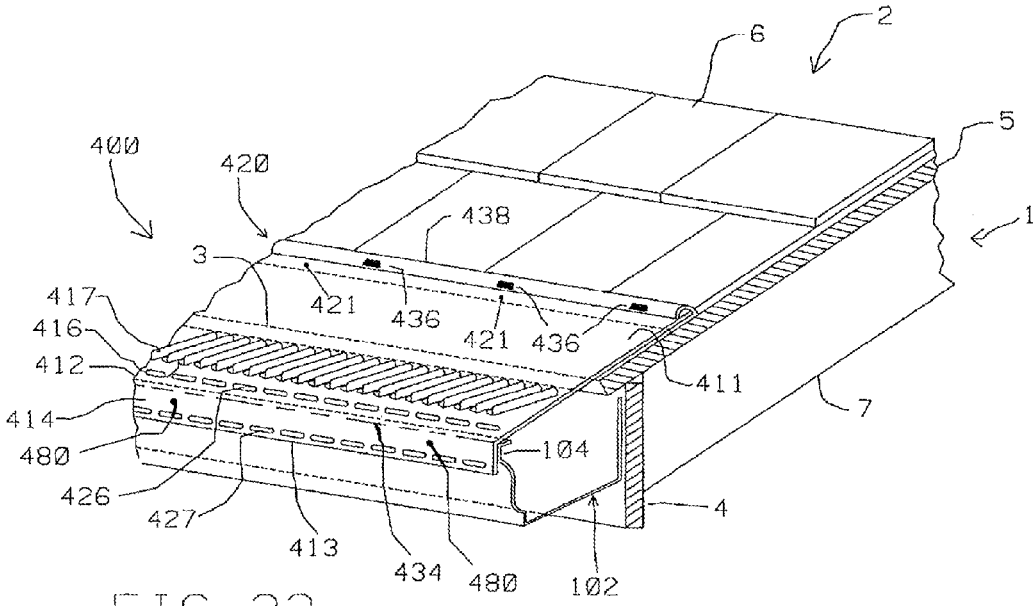
FIG. 22 is a perspective view showing a fourth embodiment of a cover assembly according to the invention connected to a structure.
Figure 23:
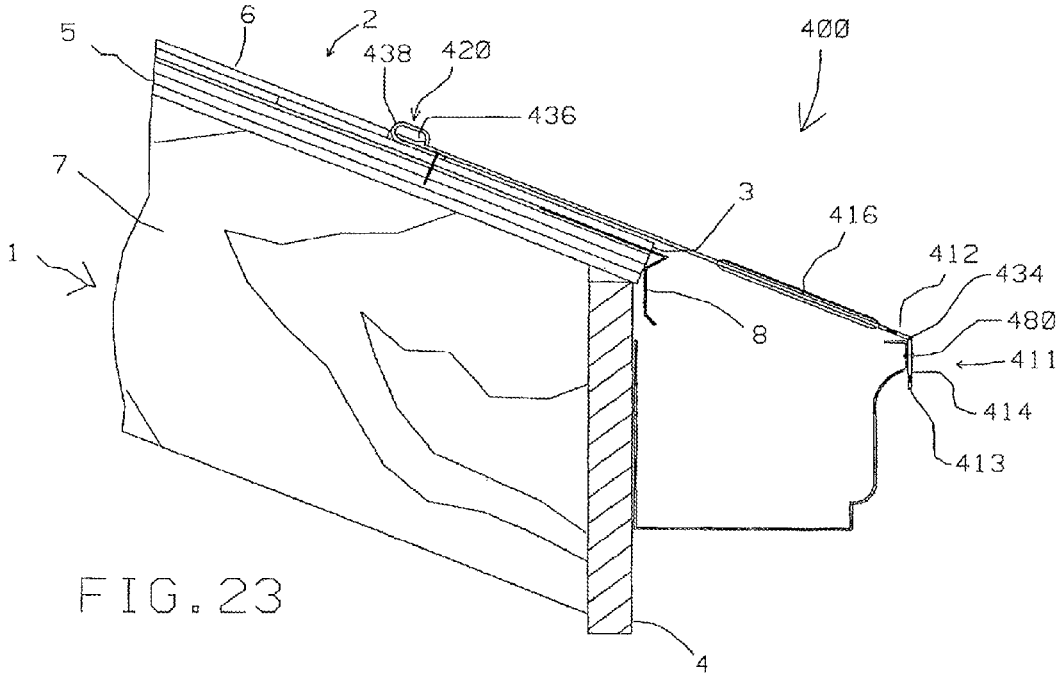
FIG. 23 is a side cross-section view showing the cover assembly of FIG. 22 connected to a structure.

FIGS. 22-23 show a fourth embodiment of a cover assembly 400. The cover assembly 400 is similar to the cover assembly 300 but is different therefrom in that no part of the cover assembly 400 is disposed within the internal notch 106 of the conventional eaves trough 102.

The body 411 of the cover assembly 400 is attached to the structure 1 using an upper fastening structure 420 including a channel member 438 and engaging members 436. The body 411 has an upper portion 412 and a lower portion 414 that meet at a longitudinal transition 434. Similar to that described in connection with other embodiments herein, apertures 416 and water guiding members 417 are provided to direct water into the conventional eaves trough 102.

In contrast to the cover assembly 300, the lower portion 414 of the body 411 of the cover assembly 400 extends downwardly from the longitudinal transition 434 in direct-facing engagement with the outermost surface 104 of the conventional eaves trough 102, such that the lower portion 414 of the body 411 is substantially coplanar to the outermost surface of the conventional eaves trough 102. An outer edge 413 of the lower portion 414 of the body 411 terminates either along or substantially downward of the outermost surface 104 of the conventional eaves trough 102. Fasteners 480, such as rivets, screws, adhesives, or any other conventional fasteners, are provided to connect the lower portion 414 of the body 411 to the outermost surface 104 of the conventional eaves trough 102 and may extend through both the lower portion 414 of the body 411 and the outermost surface 104 of the conventional eaves trough 102, to the extent that the fasteners 480 are piercing-type fasteners, to provide a secure connection between the body 411 of the cover assembly 400 and the conventional eaves trough 102.

The body 411 may also include drainage apertures 426 and fastening apertures 427 similar to those previously described.

While the invention has been described in connection with what is presently considered to be the most practical and preferred embodiment, it is to be understood that the invention is not to be limited to the disclosed embodiments, but to the contrary, it is intended to cover various modifications or equivalent arrangements included within the spirit and scope of the appended claims. The scope is to be accorded the broadest interpretation so as to encompass all such modifications and equivalent structures as is permitted under the law.

What is claimed is:

1. A cover assembly for an eaves trough that is connected to a structure for receiving water from the structure, comprising:

an elongated body that extends along a longitudinal axis and extends integrally from a first longitudinal edge to a second longitudinal edge, wherein the body at least partially overlies the structure and at least partially overlies the eaves trough to prevent debris from entering an interior of the eaves trough;

a plurality of apertures formed through the body such that the apertures overlie the eaves trough, wherein the water travels from the structure onto the body and through the apertures to the interior of the eaves trough; and an upper fastening structure that connects the body to the structure, the upper fastening structure having a longitudinally extending first channel member that is connected to the structure and an upper engaging member disposed on the body near the first longitudinal edge thereof, the upper engaging member releasably engageable with the first channel member to releasably secure the first longitudinal edge of the body to the structure.

2. The cover assembly stated in claim 1, further comprising:

a lower fastening structure that connects the body to at least one of the structure or the eaves trough adjacent to the second longitudinal edge of the body.

3. The cover assembly stated in claim 2, further comprising:

the body including a longitudinal transition that divides the body longitudinally into an upper portion and a lower portion, wherein the upper portion of the body at least partially overlies the structure and completely overlies the trough, and the lower portion extends downward from the upper portion and inward toward the structure; and the lower fastening structure having a longitudinally extending second channel member that is connected to the structure and a lower engaging member disposed on the lower portion of the body near the second longitudinal edge thereof, the lower engaging member releasably engageable with the second channel member to releasably secure the second longitudinal edge of the body to the structure.

4. The cover assembly stated in claim 3, wherein the lower portion of the body is substantially arcuate and extends inward from the longitudinal transition toward the structure such that the eaves trough is disposed entirely within a space defined by the body and the structure.

5. The cover assembly stated in claim 3, wherein the upper portion of the body is substantially planar.

6. The cover assembly stated in claim 3, wherein the upper portion of the body extends at an angle of about 90 degrees with respect to the lower portion of the body at the longitudinal transition.

7. The cover assembly stated in claim 2, wherein the lower fastening structure includes the second longitudinal edge of the body being configured to be disposed within the interior of the eaves trough such that the body is engageable with the eaves trough to retain the second longitudinal edge of the body within the eaves trough.

8. The cover assembly stated in claim 2, wherein the lower fastening structure includes fasteners that secure the body to the eaves trough at or adjacent to the second longitudinal edge of the body.

9. The cover assembly stated in claim 2, further comprising:

the lower fastening structure having a longitudinally-extending second channel member that is connected to the structure, and one or more retainer straps that are connected to the second channel member and to the body for securing the second channel member with respect to the body.

10. The cover assembly stated in claim 1, further comprising:

a plurality of water guiding members disposed on the body, wherein each water guiding member is adjacent to a respective aperture of the plurality of apertures to direct the water into the respective aperture.

11. The cover assembly stated in claim 10, further comprising:

a water flow path defined at least along a portion of the body substantially perpendicular to a longitudinal axis thereof;

the body configured to be connected to the structure in a first configuration, wherein the apertures and water-guiding members extend at a first acute angle with respect to the water flow path; and the body configured to be connected to the structure in a second configuration, where the body is upside down with respect to the first configuration, and wherein the apertures and water-guiding members extend at a second acute angle with respect to the water flow path, the second acute angle being opposite in direction to the first acute angle.

12. The cover assembly stated in claim 1, further comprising:

a water flow path defined along at least a portion of the body substantially perpendicular to a longitudinal axis thereof, wherein each aperture is elongated and extends along an axis that forms an acute angle with the water flow path.

13. The cover assembly stated in claim 12, further comprising:

each aperture having an upstream edge and a downstream edge with respect to the water flow path; and a plurality of water guiding members each extending at least partially upward from the body along the downstream edge of a respective aperture of the plurality of apertures to direct the water into the respective aperture.

14. The cover assembly stated in claim 13, further comprising:

the apertures of the plurality of apertures aligned in a side-by-side fashion along the longitudinal axis of the body.

15. A cover assembly for an eaves trough that is connected to a structure that includes a downwardly sloping roof surface having a terminal edge and a fascia that extends generally downward from the roof surface near the terminal edge of the roof surface for receiving water from the structure, the cover assembly comprising:

an elongated body that extends along a longitudinal axis and extends integrally from a first longitudinal edge to a second longitudinal edge, wherein the body at least partially overlies the roof surface of the structure and at least partially overlies the eaves trough to prevent debris from entering an interior of the eaves trough;

a plurality of apertures formed through the body such that the apertures overlie the eaves trough, wherein the water travels from the structure onto the body and through the apertures to the interior of the eaves trough; and an upper fastening structure that connects the body to the structure, the upper fastening structure having a longitudinally extending first channel member that is connected to the structure and disposed on the roof surface of the structure, and an upper engaging member disposed on the body near the first longitudinal edge thereof, the upper engaging member releasably engageable with the first channel member to releasably secure the first longitudinal edge of the body to the structure.

16. The cover assembly stated in claim 15, further comprising:

the body including a longitudinal transition that divides the body longitudinally into an upper portion and a lower portion, wherein the upper portion of the body at least partially overlies the roof surface of the structure and completely overlies the trough, and the lower portion extends downward from the upper portion and inward toward the fascia of the structure; and a lower fastening structure having a longitudinally extending second channel member that is connected to the fascia of the structure and a lower engaging member disposed on the lower portion of the body near the second longitudinal edge thereof, the lower engaging member releasably engageable with the second channel member to releasably secure the second longitudinal edge of the body to the structure, wherein the upper portion of the body is substantially planar, and the lower portion of the body is substantially arcuate and extends inward from the longitudinal transition toward the fascia of the structure such that the eaves trough is disposed entirely within a space defined by the body and the structure.

17. The cover assembly stated in claim 16, wherein the upper portion of the body extends at an angle of about 90 degrees with respect to the lower portion of the body at the longitudinal transition.

18. The cover assembly stated in claim 15, wherein a lower fastening structure includes the second longitudinal edge of the body being configured to be disposed within the interior of the eaves trough such that the body is engageable with the eaves trough to retain the second longitudinal edge of the body within the eaves trough.

19. The cover assembly stated in claim 15, wherein a lower fastening structure includes fasteners that secure the body to the eaves trough at or adjacent to the second longitudinal edge of the body.

20. The cover assembly stated in claim 15, further comprising:

a lower fastening structure having a longitudinally-extending second channel member that is connected to the fascia of the structure, and one or more retainer straps that are connected to the second channel member and to the body for securing the second channel member with respect to the body.

* * * * *